US007723926B2

(12) United States Patent
Mednik et al.

(10) Patent No.: US 7,723,926 B2
(45) Date of Patent: May 25, 2010

(54) SHUNTING TYPE PWM DIMMING CIRCUIT FOR INDIVIDUALLY CONTROLLING BRIGHTNESS OF SERIES CONNECTED LEDS OPERATED AT CONSTANT CURRENT AND METHOD THEREFOR

(75) Inventors: Alexander Mednik, Campbell, CA (US); Rohit Tirumala, Sunnyvale, CA (US)

(73) Assignee: Supertex, Inc., Sunnyvale, CA (US)

( * ) Notice: Subject to any disclaimer, the term of this patent is extended or adjusted under 35 U.S.C. 154(b) by 227 days.

(21) Appl. No.: 11/748,035

(22) Filed: May 14, 2007

(65) Prior Publication Data

US 2007/0262724 A1 Nov. 15, 2007

Related U.S. Application Data

(60) Provisional application No. 60/747,250, filed on May 15, 2006.

(51) Int. Cl.
*H05B 37/02* (2006.01)

(52) U.S. Cl. ..... 315/291; 315/294; 315/247

(58) Field of Classification Search ..... 315/1, 315/82, 86, 161, 169.3, 185 R, 185 S, 189, 315/192, 200 A, 205, 209 R, 224, 239, 241 P, 315/241 S, 247, 265, 276, 278, 291, 292, 315/294, 295, 307, 308, 312, 362, 268.27, 315/370, 371, 387, 400, 402, 403, 408, 411, 315/DIG. 2, DIG. 4, DIG. 5, DIG. 7; 345/102, 345/204, 211, 212, 39, 46, 82, 83, 87; 363/101, 363/124, 128, 132, 135, 16, 160, 161, 17, 363/18, 19, 22, 25, 28, 37, 44, 58, 80, 89, 363/96, 97

See application file for complete search history.

(56) References Cited

U.S. PATENT DOCUMENTS

| | | | | |
|---|---|---|---|---|
| 6,201,605 | B1 * | 3/2001 | Shiga | 356/394 |
| 2005/0083110 | A1 * | 4/2005 | Latham et al. | 327/538 |
| 2006/0038803 | A1 * | 2/2006 | Miller et al. | 345/204 |
| 2008/0116818 | A1 * | 5/2008 | Shteynberg et al. | 315/192 |

* cited by examiner

*Primary Examiner*—Douglas W Owens
*Assistant Examiner*—Jae K Kim
(74) *Attorney, Agent, or Firm*—Jeffrey D. Moy; Weiss & Moy, P.C.

(57) ABSTRACT

A dimming circuit for driving a string of LEDs at constant current has a power converter. A control circuit is coupled to the power converter. A plurality of shunt switches is provided. An individual shut switch is coupled to each LED. Each LED can be shunted individually by the individual shunt switch. The control circuit corrects an internal DC state based on a feedback signal $V_O$ so that the output current of the power converter remains unchanged when at least one LED is shunted.

8 Claims, 5 Drawing Sheets

SHUNTING TYPE PWM DIMMING CIRCUIT FOR INDIVIDUALLY CONTROLLING BRIGHTNESS OF SERIES CONNECTED LEDS OPERATED AT CONSTANT CURRENT AND METHOD THEREFOR

RELATED APPLICATION

This application is related to U.S. Provisional Application Ser. No. 60/747,250, filed May 15, 2006, in the name of the same inventors listed above, and entitled, "SHUNTING TYPE PWM DIMMING CIRCUIT FOR INDIVIDUALLY CONTROLLING BRIGHTNESS OF SERIES CONNECTED LEDS OPERATED AT CONSTANT CURRENT", the present patent application claims the benefit under 35 U.S.C. §119(e).

FIELD OF THE INVENTION

The invention relates to a lighting circuit, and specifically to a shunting type PWM dimming circuit for individually controlling brightness of series connected LEDS operated at constant current.

BACKGROUND OF THE INVENTION

Recent developments of Light Emitting Diodes (LED) backlights for Liquid Crystal Display (LCD) panel displays in televisions and monitors require driving large arrays of LEDs. In many applications, it is desirable to individually control the brightness level of the LEDs. For optimum performance, high brightness LEDs should be driven by a current source rather than by a voltage source. While present circuits to control the brightness levels do work, it is desirable to Page: 2 reduce the required number of power converters, i.e. more than one LED can be powered from each converter. Furthermore, prior art circuits have several issues relating to slow PWM dimming transitions of the LED current and delays and overshoots in the LED current.

Therefore, a need exists to provide a device and method to overcome the above problem.

SUMMARY OF THE INVENTION

In accordance with one embodiment of the present invention, a dimming circuit for driving a string of LEDs at constant current is disclosed. The dimming circuit has a power converter. A control circuit is coupled to the power converter. A plurality of shunt switches is provided. An individual shut switch is coupled to each LED. Each LED can be shunted individually by the individual shunt switch. The control circuit corrects an internal DC state based on a feedback signal $V_O$ so that the output current of the power converter remains unchanged when at least one LED is shunted.

In accordance with another embodiment of the present invention, a dimming circuit for individual controlling brightness of series-connected LEDs driven at constant current is disclosed. The dimming circuit has a first plurality of switching devices. A signal switching device of the first plurality is coupled to an individual LED of series connected LEDS to control a brightness of the individual LED by periodically shunting the individual LED. A plurality of smoothing capacitors is provided. A single smoothing capacitor is coupled to each single switching device of the first plurality. A second plurality of switching devices is provided. A single switching device of the second plurality is coupled in series with a single smoothing capacitor for disconnecting the single smoothing capacitor. A switching power converter is provided for supplying a constant output current to the series connected LEDs. Individual smoothing capacitors become disconnected when a corresponding LED is shunted.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings, wherein like reference numerals and symbols represent like elements.

DESCRIPTION OF PREFERRED EMBODIMENT

Figure 1:
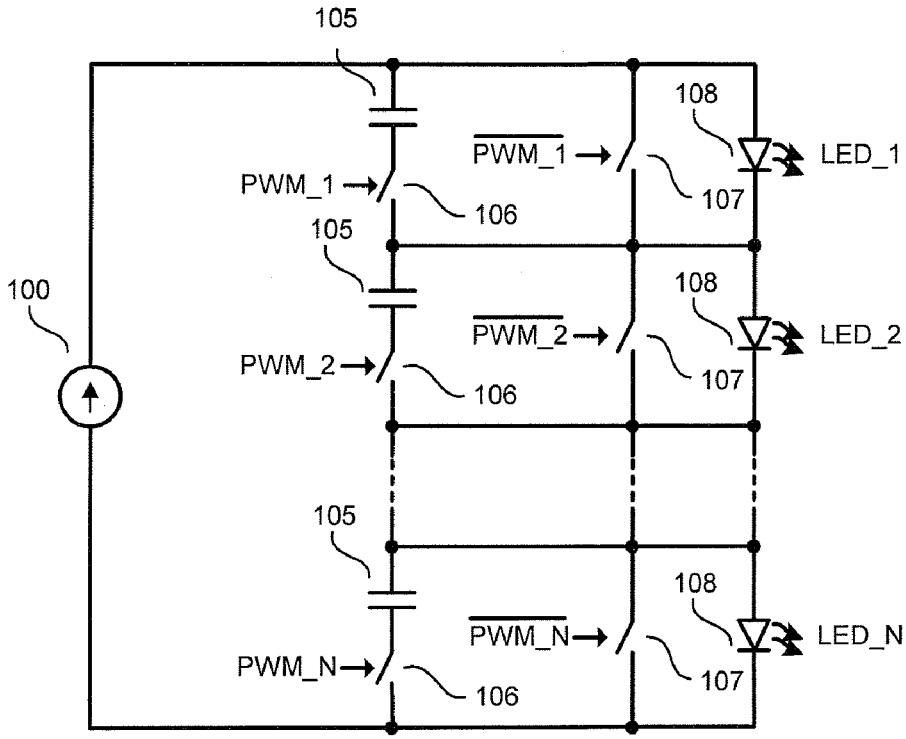
FIG. 1 depicts a power supply circuit for driving a string of LEDs at constant current and individual dimming control of each LED in the string.

Referring to FIG. 1, a power supply circuit for driving a string of LEDs 108 at constant current is shown. Power to the LED string is supplied from a switching power converter 100 operating in a constant DC output current mode. There is little or no smoothing capacitor assumed at the output of the power converter 100. Thus, the output current of the power converter 100 is assumed to have a significant AC ripple component. The AC ripple is further filtered using smoothing capacitors 105.

Each LED 108 is equipped with an independently controlled switch 107 adapted to shunt the corresponding LED 108. Brightness of each LED 108 is individually controlled by periodically shunting it using the corresponding switch 107. Each switch 107 is controlled by external periodical dimming signals PWM_1 through PWM_N having controlled duty ratios.

Switches 106 are included in series with each smoothing capacitor 105 for disconnecting the capacitor 105 from the LED 108. The switches 106 are operated out of phase with the switches 107, so that a switch 106 turns off whenever the corresponding shunting switch 107 is on and visa-versa. This ensures that the capacitor 105 preserves its steady-state charge while the corresponding LED 108 is shunted.

The power supply circuit of FIG. 1 achieves fast PWM dimming transitions of the LED current and eliminates delays and overshoots in the LED 108 current.

Figure 2:
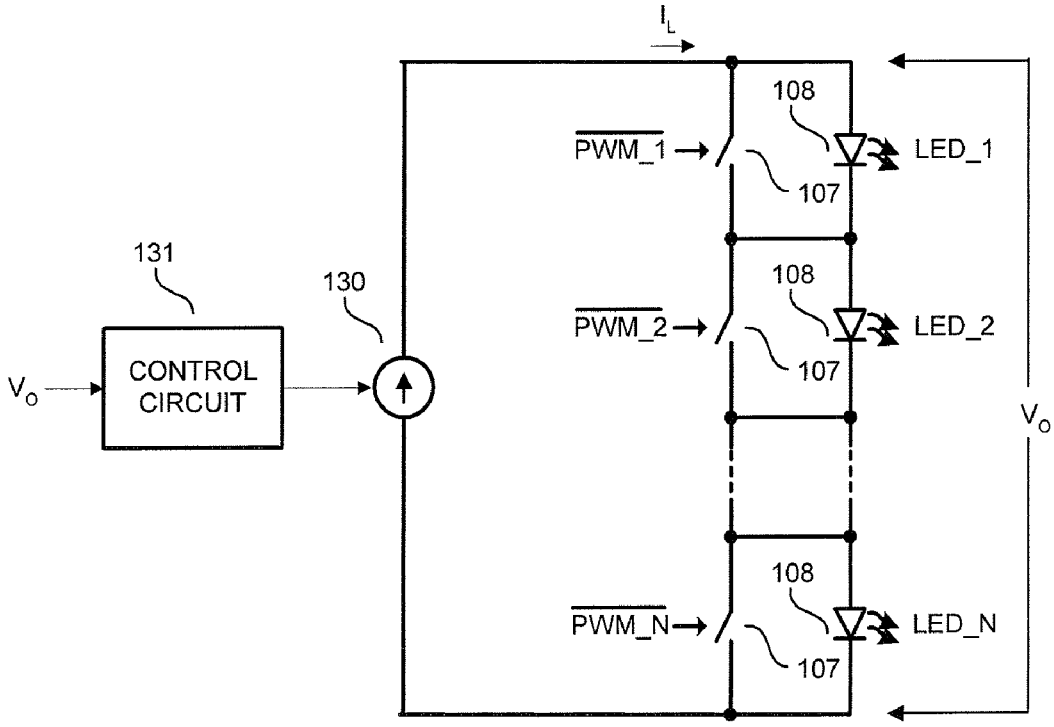
FIG. 2 depicts a power supply circuit for driving a string of LEDs 108 at constant current with regulation of the LED current by using a feedback of the voltage drop across the LED string.

Referring to FIG. 2, a power supply circuit for driving a string of LEDs 108 at constant current is shown. The power supply circuit includes a switching power converter 130 supplying constant current to a string of LEDs 108. The power supply circuit also comprises a control circuit 131 for controlling the output current of the power converter 130. The control circuit 131 is also adapted to receive a feedback signal $V_O$ representative of the output voltage across the LED string.

Each LED 108 is equipped with an independently controlled switch 107 adapted to shunt the corresponding LED 108. Brightness of each LED 108 is individually controlled by periodically shunting it using the corresponding switch 107. Each switch 107 is controlled by external periodical dimming signals PWM1 through PWM_N having controlled duty ratios.

In operation, the control circuit 131 instantly corrects its internal DC state based on the feedback signal $V_O$ in such a way that the output current of the power converter 130 remains unchanged when switches 107 close.

Figure 3:
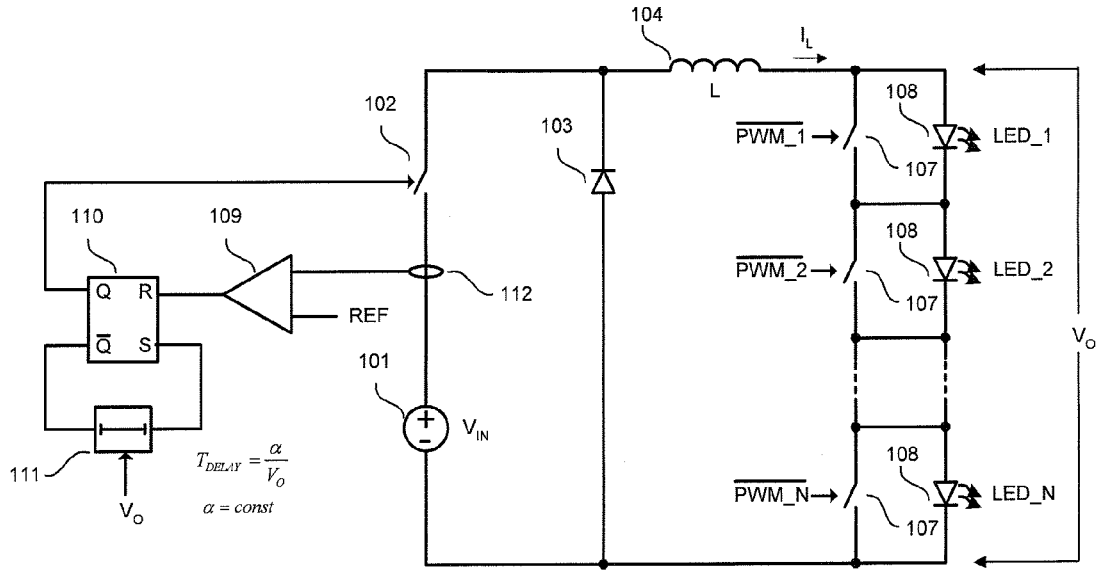
FIG. 3 shows a power supply circuit of FIG. 2 wherein power to the LED string is supplied using a step-down DC-DC converter of a buck type that operates in a constant off-time mode wherein the off-time is made inverse proportional to the voltage drop across the LED string.

Referring to FIG. 3, a power supply circuit of FIG. 2 is shown wherein power to the LED string is supplied using a step-down DC-DC converter of a buck type that receives input voltage $V_{IN}$ from the input power supply 101. Each LED 108 is equipped with an independently controlled switch 107 adapted to shunt the corresponding LED 108. The converter comprises a control switch 102, a catch diode 103, and a filter inductor 104 having inductance value L. The converter also comprises a control circuit for controlling the switch 102 in accordance with the output current and the output voltage $V_O$ of the converter. The control circuit includes a current sensing device 112, a reference REF, a peak current comparator 109, a flip-flop circuit 110, and a controlled delay circuit 111.

In operation, the switch 102 is biased conducting by the output of the flip-flop circuit 110 applying the input voltage $V_{IN}$ to the input of the inductor 104. The diode 103 is reverse-biased. The current $I_L$ in the inductor 104 is increasing linearly until the signal from the current sensing device 112 exceeds the reference REF. When this occurs, the comparator 109 changes its output state and resets the flip-flop 110. The switch 102 turns off, and the catch diode 103 conducts the inductor current $I_L$. The off-time of the switch 102 is determined by the delay circuit 111 by making this off-time inverse-proportional to the instantaneous output voltage $V_O$ across the LED string. Therefore, the product of $V_O{*}T_{DELAY}$ is maintained constant with any number of LEDs in the string.

Brightness of each LED is individually controlled by periodically shunting it using a corresponding switch 107. Each switch 107 is controlled by external periodical dimming signals PWM1 through PWM_N having controlled duty ratios.

Figure 4:
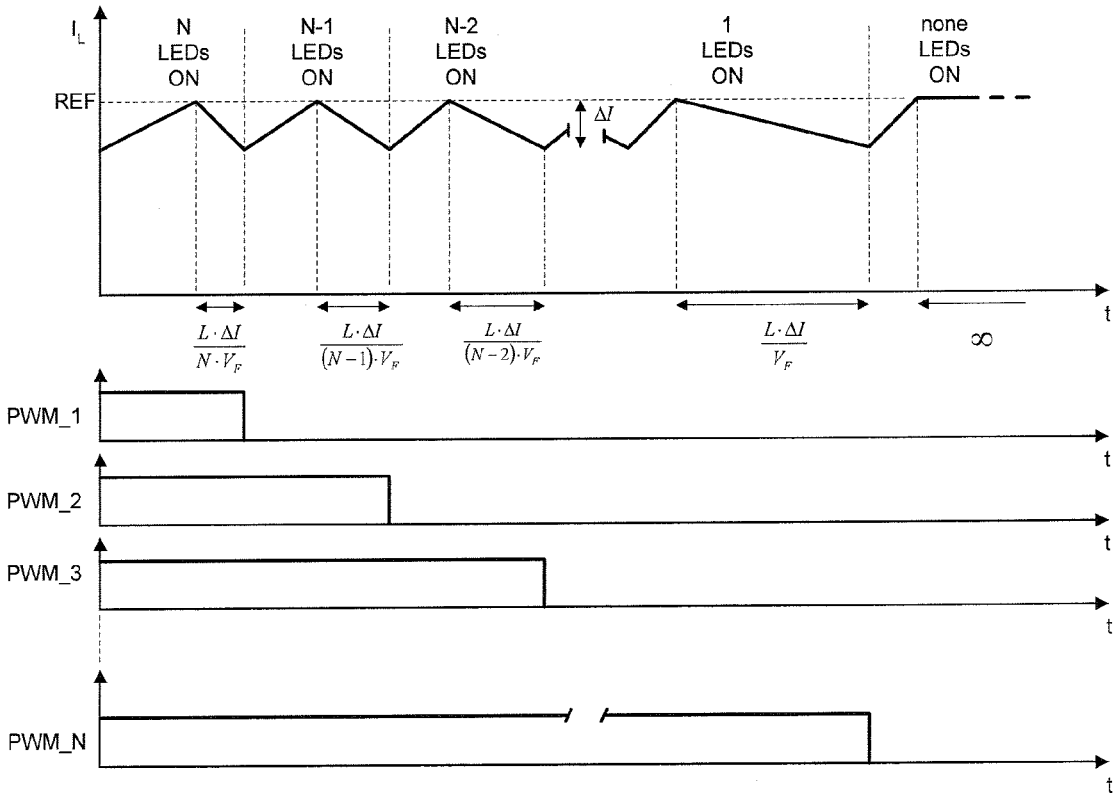
FIG. 4 depicts the waveform of $I_L$, the current in the LED string as a function of the dimming signal states for FIG. 3.

FIG. 4 depicts the waveform of $I_L$ as a function of the dimming signal states. Switching transitions of the switch 102 are depicted coinciding with the transitions of the switches 107 for the sake of representation simplicity rather than in the limiting sense. Moreover, it is expected that the frequency of the brightness control signals PWM_X is substantially lower than the switching frequency of the switch 102. And even furthermore, the dimming control signals PWM_X do not necessarily need to be synchronized. Referring to FIGS. 3 and 4, inductor 104 is operated in continuous conduction mode (CCM) wherein the peak-to-peak current ripple ΔI is low enough so that $I_L$ never equals to zero. The ripple ΔI is maintained constant since $\Delta I = V_O{*}T_{DELAY}/L$. Therefore, the average current in the LED string remains undisturbed with any number of LEDs being shunted.

Figure 5:
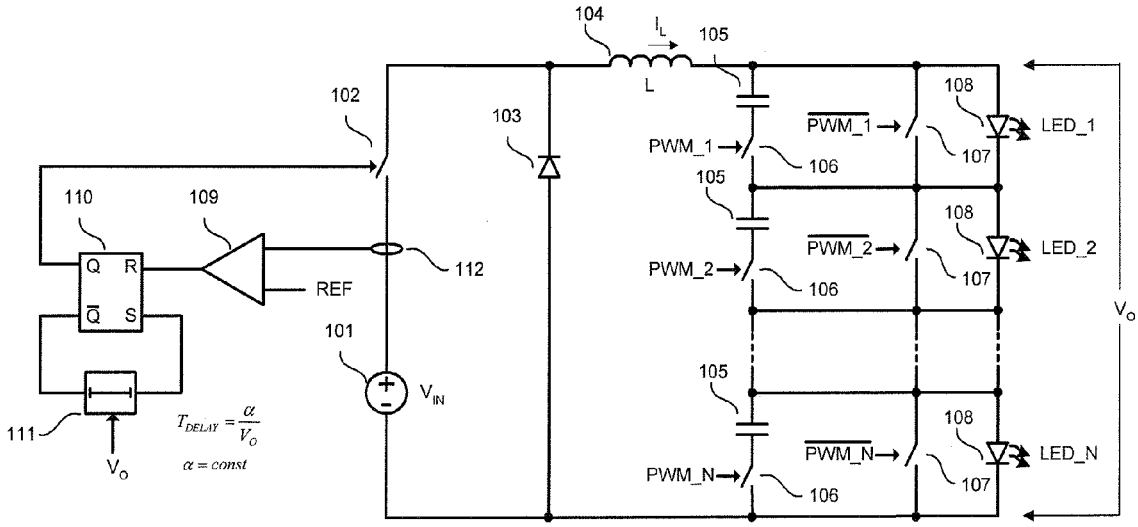
FIG. 5 depicts the LED driver of FIG. 3 with the addition of filter capacitors and corresponding disconnect switches as described in FIG. 1.

The LED driver of FIG. 3 suffers a relatively high ripple current in the LEDs 108, since it includes no output filter capacitor to bypass the ripple ΔI. FIG. 5 depicts the LED driver of FIG. 4 with the addition of filter capacitors 105 and corresponding disconnect switches 106 as described in FIG. 1.

Figure 6:
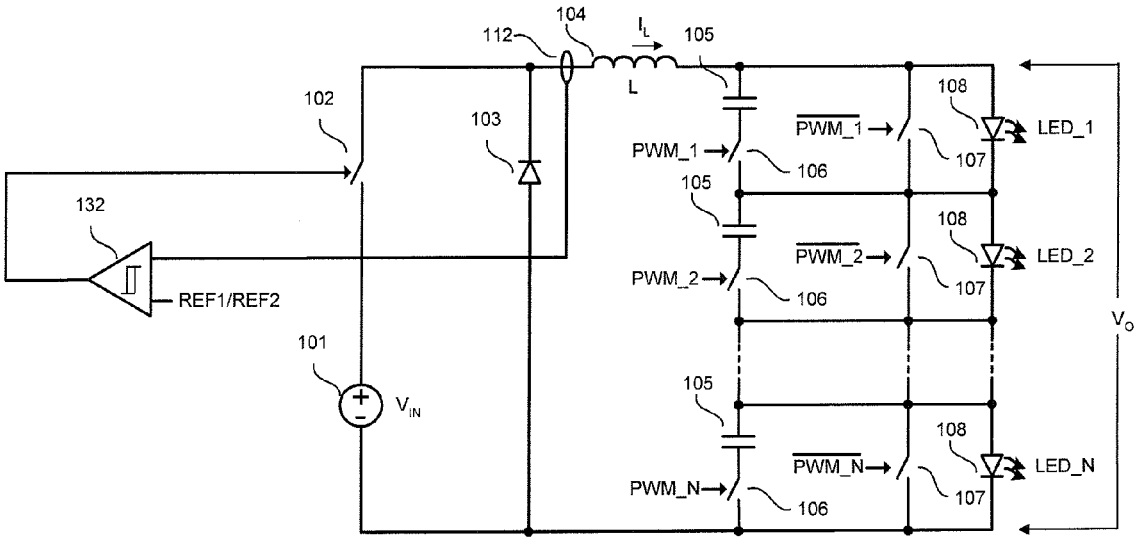
FIG. 6 is shows another example of the power supply circuit of FIG. 1 wherein power to the LED string is supplied using a step-down DC-DC converter of a buck type that operates in hysteretic current control mode.

Referring to FIG. 6, another example of the power supply circuit of FIG. 1 is shown. In FIG. 6, the power to the LED string is supplied using a step-down DC-DC converter of a buck type that receives input voltage $V_{IN}$ from the input power supply 101. The DC-DC converter comprises a control switch 102, a catch diode 103, and a filter inductor 104 having inductance value L. The converter also comprises a current sense comparator 132 for controlling the switch 102 in accordance with the output of a current sensing means 112. The current sensing means 112 monitors the current $I_L$ in the inductor 104 and outputs a signal proportional to $I_L$. In operation, the switch 102 turns on when the output of the current sensing means 112 falls below first reference level REF1. The diode 103 becomes reverse-biased. The current $I_L$ in the inductor 104 increases linearly until the signal from the current sensing means exceeds second reference level REF2. When this occurs, the comparator 132 changes its output state, the switch 102 turns off, and the catch diode 103 conducts the inductor current $I_L$.

Brightness of each LED is individually controlled by periodically shunting it using a corresponding switch 107. Each switch 107 is controlled by external periodical dimming signals PWM1 through PWM_N having controlled duty ratios.

The power supply circuit of FIG. 6 exhibits an inherent $V_O$ feedback of FIG. 2 since the slew rate of the down-slope of $I_L$ is proportional to $V_O$.

Figure 7:
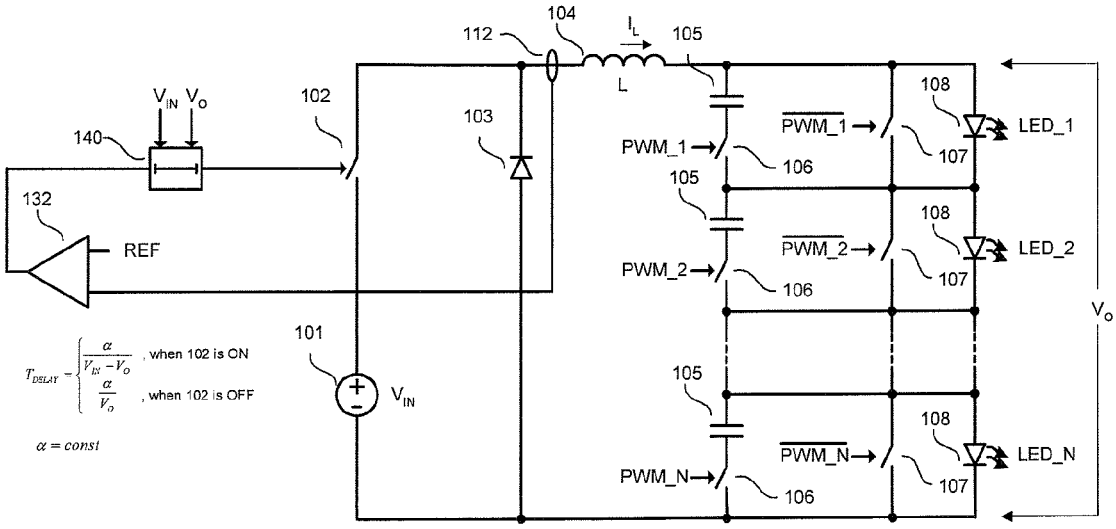
FIG. 7 depicts yet another embodiment of the power supply circuit of FIG. 1 using the output voltage feedback of FIG. 2 wherein the step-down DC-DC converter is of a time-delay hysteretic type.

FIG. 7 depicts yet another embodiment of the power supply circuit of FIG. 1 using the output voltage feedback of FIG. 2 wherein the step-down DC-DC converter is of a time-delay hysteretic type. Similarly, the DC-DC converter comprises a control switch 102, a catch diode 103, and a filter inductor 104 having inductance value L. The converter also comprises a current sense comparator 132 for controlling the switch 102 in accordance with the output of a current sensing means 112. The current sensing means 112 monitors the current $I_L$ in the inductor 104 and outputs a signal proportional to $I_L$. The converter also includes a controlled time delay circuit 140 delaying switching transitions of the switch 102 with respect to the output signal of the comparator 132. The time delay circuit 140 is controlled in such a way that it delays the comparator 132 output by a time inverse proportional to the output voltage $V_O$ when the switch 102 is off. When the switch 102 is on, the time delay 140 is inverse proportional to the difference between the input voltage $V_{IN}$ and the output voltage $V_O$.

Figure 8:
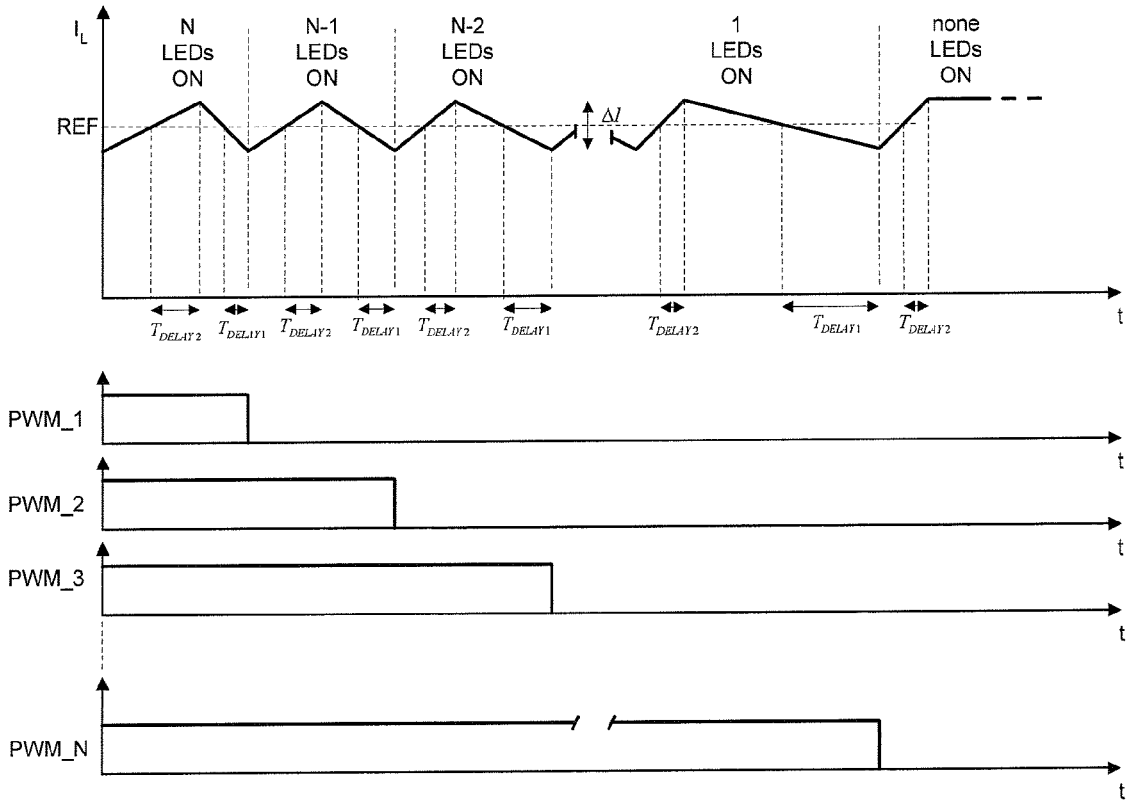
FIG. 8 shows the inductor current ($I_L$) waveforms illustrating the operation of the power supply circuit of FIG. 7 as a function of the dimming signal states.

FIG. 8 shows the inductor 104 current ($I_L$) waveforms illustrating the operation of the power supply circuit of FIG. 7. The switch 102 turns on after a time delay $T_{DELAY1}$ triggered by the output of the current sensing means 112 falling below the reference level REF. When one or more LEDs 108 is shunted by its corresponding switches 107, $T_{DELAY1}$ is controlled in the inverse proportion with the resulting output voltage $V_O$. Thus, the ripple current ΔI remains unchanged. The switch 102 turns off after a time delay $T_{DELAY2}$ triggered by the output of the current sensing means 112 exceeding the reference level REF. The time delay $T_{DELAY2}$ is made inverse-proportional to the voltage across the inductor 104 which is the difference between $V_{IN}$ and $V_O$. Since the slew rate of $I_L$ is inverse-proportional to $(V_{IN}-V_O)$ when the switch 102 is on, the average current in the inductor 104 remains unchanged with respect to the variation of the input voltage $V_{IN}$. Thus, the number of LEDs 108 shunted does not affect the DC value of $I_L$, and the PWM dimming does not affect the instantaneous current in the LEDs 108.

Figure 9:
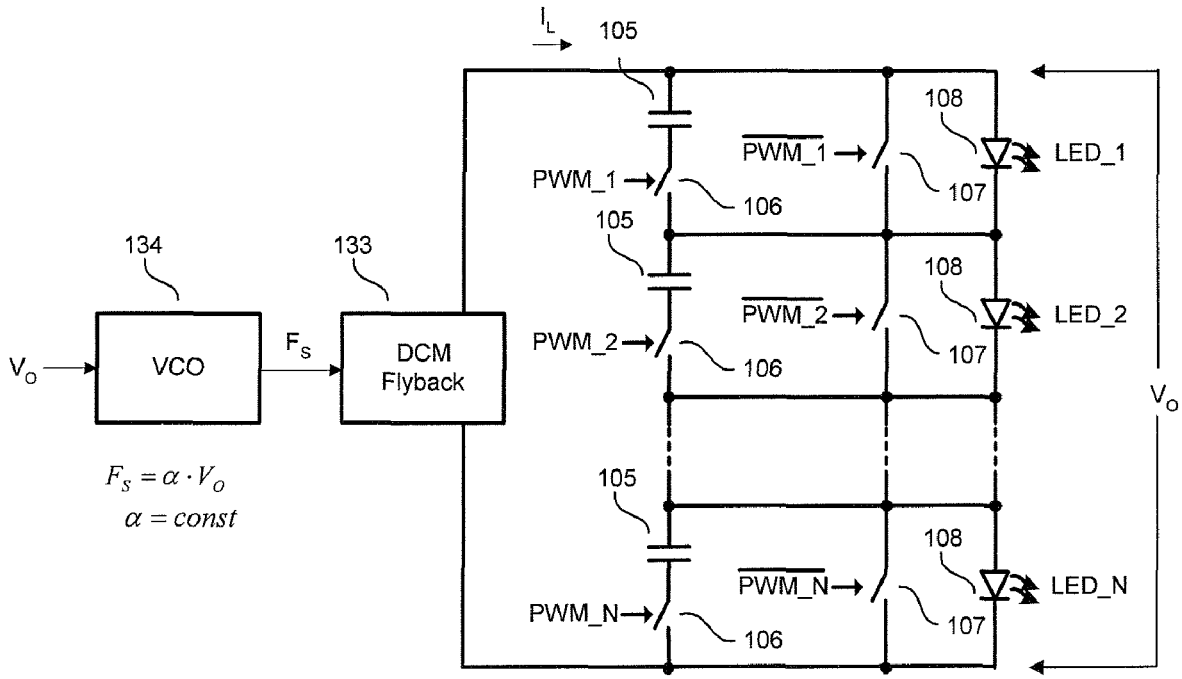
FIG. 9 shows another embodiment of the power supply circuit of FIG. 1 using the output voltage feedback of FIG. 2.

Another embodiment of the power supply circuit of FIG. 1 using the output voltage feedback of FIG. 2 is depicted in FIG. 9. The DC-DC converter 133 is of a flyback type operating in discontinuous conduction mode (DCM). The power supply circuit includes a voltage-controlled oscillator 134 receiving the output voltage signal $V_O$ and controlling the DC-DC converter at a switching frequency $F_S$ proportional to $V_O$. Since the output power of a DCM flyback converter is inherently proportional to its switching frequency, the LED 108 current will remain unchanged regardless of the number of the LEDs 108 shunted.

Thus, a circuit and a method are shown achieving individual brightness control of LEDs in the series-connected LED string operated at constant current by shunting individual LEDs in the string. The output current disturbance, normally associated with the shunting transitions in the prior art, is removed by adding the output voltage feedback compensation.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A dimming circuit for individual controlling brightness of series-connected LEDs driven at constant current comprising:

a first plurality of switching devices, a signal switching device of the first plurality coupled to an individual LED of series connected LEDS to control a brightness of the individual LED by periodically shunting the individual LED;

a plurality of smoothing capacitors, a single smoothing capacitor coupled to each single switching device of the first plurality;

a second plurality of switching devices, a single switching device of the second plurality coupled in series with a single smoothing capacitor for disconnecting the single smoothing capacitor; and a switching power converter for supplying a constant output current to the series connected LEDs;

wherein individual smoothing capacitors become disconnected when a corresponding LED is shunted.

2. A dimming circuit for driving a string of LEDs at constant current comprising:

a power converter;

a control circuit coupled to the power converter;

a plurality of shunt switches, an individual shunt switch coupled to each LED, wherein each LED can be shunted individually by the individual shunt switch, and wherein the control circuit corrects an internal DC state based on a feedback signal $V_0$ so that the output current of the power converter remains unchanged when at least one LED is shunted;

a plurality of smoothing capacitors, a single smoothing capacitor coupled to each of the plurality of shunt switches;

a second plurality of switching devices, a single switching device of the plurality of switching devices coupled in series with a corresponding smoothing capacitor for disconnecting the corresponding smoothing capacitor; wherein individual smoothing capacitors become disconnected when a corresponding LED is shunted.

3. A power supply of claim 2 wherein the power converter comprises:

a buck type converter;

an inductor coupled to the string of LEDS; and a controlled switch coupled to the inductor;

wherein the control circuit turns the controlled switch off when the inductor current exceeds a reference level, and wherein the control circuit turns the controlled switch back on after a time period inverse proportional to the voltage at the string of LEDs.

4. A power supply of claim 2 wherein the power converter comprises:

a buck type power converter;

an inductor coupled to the string of LEDs; and a controlled switch coupled to the inductor;

wherein the control circuit turns the controlled switch off when the inductor current exceeds a first reference level, and wherein the control circuit turns the controlled switch back on when the inductor current falls below a second reference level.

5. A power supply of claim 2 wherein the power converter comprises:

a buck type power converter;

an inductor coupled to the string of LEDs; and a controlled switch coupled to the inductor;

wherein the control circuit turns the controlled switch off after a first delay following when a current of the inductor exceeds a reference level, and wherein the control circuit turns the controlled switch back on after a second time delay following when the current of the inductor falls below the same reference level, and wherein both delays are inverse proportional to a voltage across the inductor.

6. A power supply of claim 2 wherein the power converter is of a flyback type operating in discontinuous conduction mode, and wherein the switching frequency of the power converter is made proportional to the voltage across the string of LEDs.

7. A power supply of claim 2 wherein the power converter comprises:

a buck type power converter;

an inductor coupled to the string of LEDs; and a controlled switch coupled to the inductor;

wherein the control circuit turns the controlled switch off when the inductor current exceeds a first reference level, and wherein the control circuit turns the controlled switch back on when the inductor current falls below a second reference level and wherein the time duration of the controlled switch being off is inherently inverse proportional to the voltage at the string of LED.

8. A power supply of claim 2 wherein the power converter comprises:

a buck type power converter;

an inductor coupled to the string of LEDs; and a controlled switch coupled to the inductor;

wherein the control circuit turns the controlled switch off after a first delay following when a current of the inductor exceeds a reference level, and wherein the control circuit turns the controlled switch back on after a second time delay following when the current of the inductor falls below the same reference level, and wherein both delays are inverse-proportional to a voltage across the inductor and wherein the second delay is inverse proportional to the voltage at the string of LEDs.

* * * * *